United States Patent [19]

O'Neill

[11] 4,191,365

[45] Mar. 4, 1980

[54] HORIZONTAL/INCLINED SUBSTRATE HOLDER FOR LIQUID PHASE EPITAXY

[75] Inventor: Charles F. O'Neill, Escondido, Calif.

[73] Assignee: Burroughs Corporation, Detroit, Mich.

[21] Appl. No.: 16,884

[22] Filed: Mar. 2, 1979

[51] Int. Cl.[2] ..... B25B 11/00

[52] U.S. Cl. ..... 269/46; 296/321 WE

[58] Field of Search ..... 269/46, 321 WE; 294/31 R, 90, 27, 6, 106; 156/624; 211/41; 118/500-503

[56] References Cited

U.S. PATENT DOCUMENTS

| | | | |
|---|---|---|---|
| 521,963 | 6/1894 | Nason | 294/106 |
| 2,095,295 | 10/1937 | Smith et al. | 269/46 |
| 4,077,832 | 3/1978 | Robertson et al. | 156/624 |

*Primary Examiner*—Robert C. Watson

*Attorney, Agent, or Firm*—Joseph R. Dwyer; Kevin R. Peterson

[57] ABSTRACT

A substrate holder for use in liquid phase epitaxy growth of magnetic garnet films for bubble memories comprising a dipping rod having substrate holding means including hooks at one end which confine the substrate securely yet permit tilting movement so as to allow the substrate to assume a horizontal position for liquid phase epitaxy growth in the flux in which the substrate is immersed and to assume a tilted position as the substrate is being withdrawn from the flux for flux runoff. One embodiment discloses a substrate holder for one substrate while a second embodiment shows a holder for supporting a plurality of substrates for processing a batch of substrates in one operation.

7 Claims, 7 Drawing Figures

HORIZONTAL/INCLINED SUBSTRATE HOLDER FOR LIQUID PHASE EPITAXY

CROSS REFERENCE TO RELATED APPLICATION

Application for U.S. Patent entitled "Method for Liquid Phase Epitaxy Multiple Dipping of Wafers for Bubble Film Growth" of Charles Francis O'Neill filed Mar. 2, 1979, Ser. No. 16,883.

BACKGROUND OF THE INVENTION

This invention relates to an apparatus for use in the growth of magnetic garnets by liquid phase epitaxy and in particular to a new and improved substrate holder for use in the dipping apparatus for growing magnetic garnet films on a substrate.

LPE growth of magnetic garnets for bubble domain devices utilizing a dipping technique whereby a substrate is immersed in a crucible of supersaturated solutions is old and well known. The technique described in a number of publications, such as, "Diminishing Transient Growth Effects of LPE Bubble Domain Films" by Davies et al, *IBM Technical Disclosure Bulletin,* Vol. 17, No. 6, November 1974, page 1841, describing a method of minimizing the effects of a transient layer for films for supporting bubbles smaller than 5 microns; "Liquid Phase Epitaxial Growth of Magnetic Garnet Films by Isothermal Dipping in a Horizontal Plane with Axial Rotation" by Giess et al, *Journal of Crystal Growth,* Vol. 16, No. 1, October 1972, pp. 36–42, showing a substrate (wafer) holder for mounting a wafer in a horizontal plane for dipping into a crucible; and "The Growth of Magnetic Garnets by Liquid Phase Epitaxy" by Blank et al, *Journal of Crystal Growth,* Vol. 17, pp. 302–311, 1972 and U.S. Pat. No. 4,092,208 to Brice et al, showing a substrate holder for mounting a substrate vertically for dipping into a melt.

The prior art apparatus employs a substrate holder having a fixed mode of operation, that is, the substrate is held in a horizontal position, in a vertical position, or in a fixed tilted position; the latter facilitating flux runoff from the substrate as it is being removed from the melt.

It is also known that, for film thickness uniformity, the horizontal orientation of the substrate in the melt is most desirable, and, that for good flux runoff, a tilt of the substrate as it is being withdrawn from the melt, is desirable.

Accordingly, it is an object of this invention to provide a substrate holder for liquid phase epitaxy which allows a substrate to have a freedom of movement so that it will orient itself in a horizontal plane during the film growth, i.e., while immersed in a melt, to assure optimum uniformity of film thickness, and so that the substrate will assume a tilted position to provide good flux runoff upon withdrawal from the melt.

It is also known that with a substrate tilt of less than 10° from horizontal, flux runoff is not satisfactory but that a substrate tilt of about 15° from horizontal provides a good opportunity for the flux to runoff.

Thus, a more specific object of this invention is to provide a substrate holder which allows a substrate to have freedom of movement so it will orient itself in a horizontal plane during the film growth process and so that the substrate will assume a tilt of approximately 15° for maximizing flux runoff as a substrate is being removed from the flux.

SUMMARY OF THE INVENTION

The invention which meets the foregoing objects comprises a substrate (wafer) holder having a rod-like member (a dipping rod) which is provided at one end with a substrate holding means including a plurality of hooks which confine the substrate securely within the holder yet permit tilting movement so as to allow the substrate to assume a horizontal position in a flux for liquid phase epitaxy growth and to assume a tilted position out of the flux and particularly as substrate is being withdrawn from the flux for flux runoff.

Also shown is a substrate holder for supporting a plurality of substrates for processing a batch of substrates in one operation.

BRIEF DESCRIPTION OF THE PREFERRED EMBODIMENT

Figure 4:
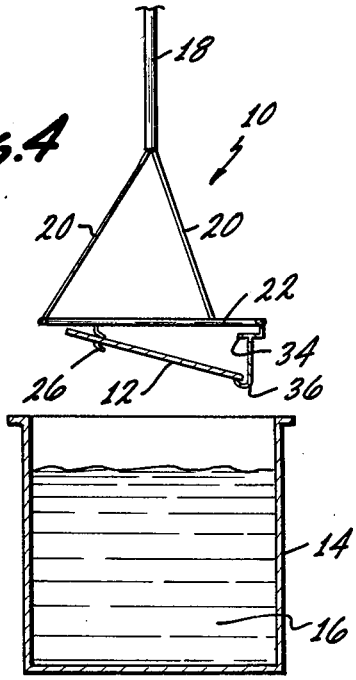
FIG. 4 is an elevational view showing the substrate and substrate holder above the crucible.
Figure 5:
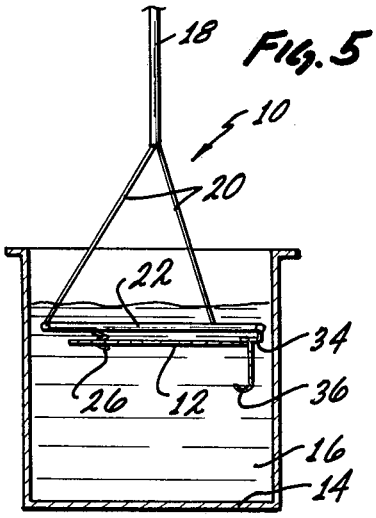
FIG. 5 is a view similar to FIG. 4 but showing the substrate assuming a horizontal position in the flux.
Figure 6:
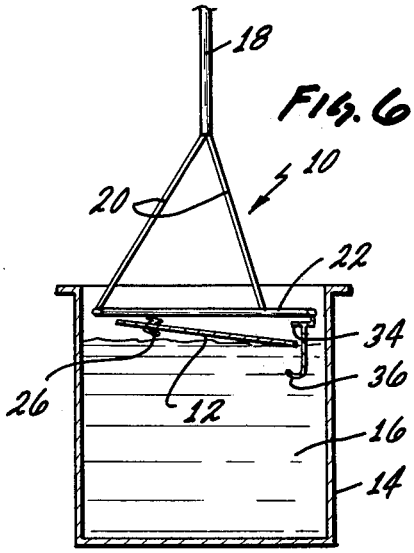
FIG. 6 is a view similar to FIGS. 4 and 5 but showing the substrate as it is being removed from the flux and showing it midway between horizontal and a full tilted position.

Before describing the substrate holder 10 comprising this invention, attention is directed to FIGS. 4–6 where there is shown a typical apparatus for performing a liquid phase epitaxial growth on a substrate or wafer 12 which includes a crucible 14 of a generally cylindrical configuration formed of suitable refractory nonreactive materials and at least partially filled with a flux material 16 to be epitaxially deposited on a substrate. The substrate is shown secured to a substrate holder constructed in accordance with this invention. Suitable means for heating the melt in the crucible and for raising and lowering the substrate holder are, of course, provided, but are not shown in the drawings since this invention is directed to the substrate holder itself. The apparatus for performing the epitaxial growth is shown to illustrate the function of the substrate holder 10 in connection therewith.

Figure 1:
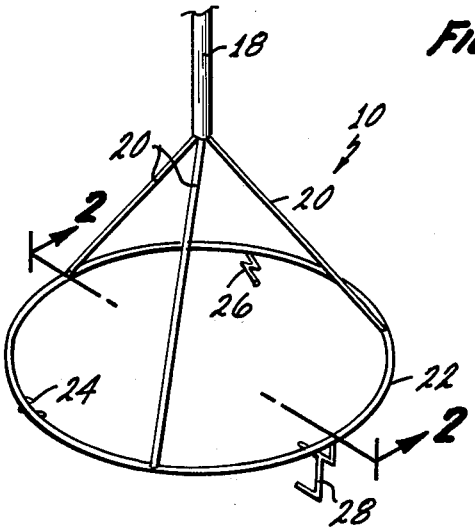
FIG. 1 is a perspective view showing the substrate holder constructed in accordance with the teachings of this invention.
Figure 3:
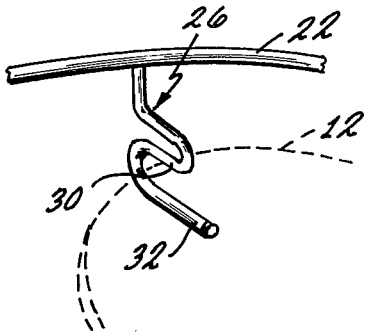
FIG. 3 is a partial enlarged view of one of the hooks for holding the substrate with the wafer shown in phantom.
Figure 2:
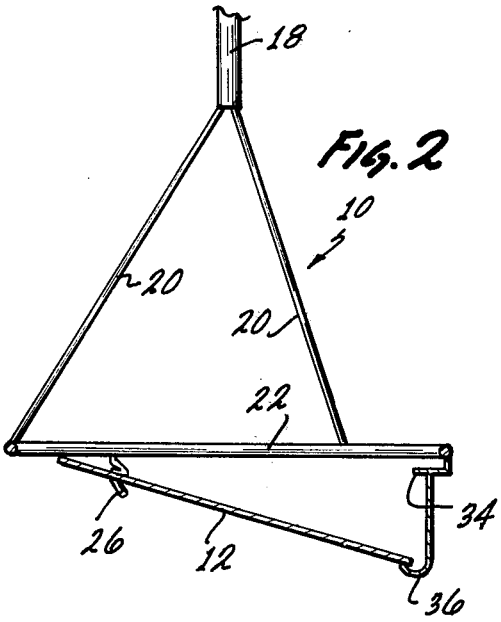
FIG. 2 is an elevational view, partly in section, and taken along line 2—2 of FIG. 1, to illustrate the hook means for holding the substrate at an angle to the horizontal plane.

Turning now to FIGS. 1–3 there is shown the substrate holder 10 which comprises a dipping rod member 18 suitable to be connected at one end to a means for operating the substrate holder, i.e., raising and lowering the substrate into the crucible and rotating the substrate in the melt. The other end of the rod is provided with substrate holding means in the form of a plurality of diverging fingers or wires 20 (three shown) which are connected to ring 22 disposed perpendicular to the axis of the rod and has a diameter commensurate with the diameter of the wafer 12.

In the embodiment illustrated, the means for confining the wafer in the substrate holder comprises hooks 24, 26 and 28, suitably affixed to the ring 22, and spaced apart approximately 120° about the ring. These hooks engage and support the substrate at its periphery.

Two of these hooks 24 and 26 extend inwardly from the ring 22 and are in an S-shaped configuration with a top portion 30 spaced from a lower portion 32. The top portion 30 forms a first stop means to prevent upward movement of the substrate 12, when the substrate is immersed in the flux, while the lower portion 32 serves as a second stop means to prevent downward movement of the substrate and serves to support the substrate out of the flux. These stop means are spaced apart sufficiently to confine the substrate yet permit limited relative rotational movement from the horizontal plane. The third hook 28 also has upper and lower portions 34, 36, respectively, which serve as stop means but are spaced apart further than the stop means on the other two hooks. The upper stop means is more or less coplanar with the ring as are the first stop means 30 and 34 while the other stop means 36 is spaced considerable distance therefrom and is in the form of a hook so as to support the substrate out of the melt and at a tilt of approximately 15° from the plane of the ring 22. The upper stop means 30 and 34, of course, serve to confine the substrate and prevent further upward movement while the substrate is in the melt.

From the foregoing, it can be seen that a substrate 12 is capable of being supported in the substrate holder in a generally tilted position, the position at which the substrate is lowered towards the melt 14 in the apparatus of FIGS. 4–6. The substrate 12 having a lower density than the melt, has a tendency to float and to assume a horizontal position while submerged in the melt (FIG. 5). Too, rotating movement of the substrate in the melt tends to further orient the substrate in a horizontal plane. During this horizontal orientation, a film of uniform thickness is grown on the substrate, then, as the substrate is being removed from the melt, as shown in FIG. 6, the substrate will again assume the tilted position for flux runoff. FIG. 6 shows the substrate about half-way between fully horizontal and fully tilted for purposes of showing the function of the substrate holder as the substrate is being removed from the melt.

Figure 7:
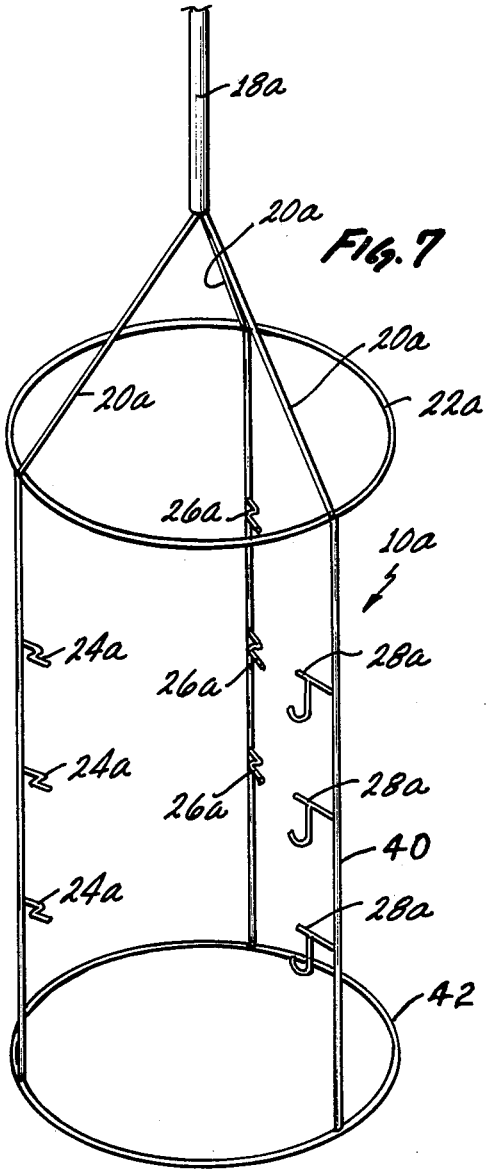
FIG. 7 is a perspective view showing the substrate holder for holding a plurality of substrates.

Turning now to FIG. 7, there is shown a substrate holder **12*a* connected to a dipping rod 18*a* as shown in FIGS. 1–6 with the diverging fingers 20*a* to which are connected extensions in the form of downwardly parallel disposed rods 40 which terminate in a second ring 42 of the same diameter as the first ring 22*a*. Ring 42 also serves to stabilize the extension rods. In this embodiment, there is provided a plurality of hook means 24*a* and 28*a* arranged in planar disposed groups (three shown) like the hook means of FIGS. 1–6. This embodiment differs from that of the other figures only in that the hook means 24*a* and 28*a* are connected to the rod extensions 40 rather than to the ring as shown in FIG. 4. Otherwise, the function in operation of the hooks are the same and for that reason those components having the same function as those of FIGS. 1–6 are given the same reference numerals except for the suffix a. In this particular substrate holder 10*a***, six substrates (three pairs back to back) have been used successfully to grow films on the substrates.

What is claimed is:

1. A substrate holder adapted for practicing liquid phase epitaxy, comprising:

a dipping rod, substrate holding means connected to one end of said rod including means holding said substrate at a tilt the angle of which is defined thereby relative to a horizontal plane when said substrate is free of liquid epitaxy melt and permitting said substrate to assume a horizontal position while yet contained in said substrate holder when said substrate is within an epitaxy melt.

2. The substrate holder as claimed in claim 1, wherein said substrate holding means comprises a plurality of hook means each having substrate engaging means in the form of pairs of stop means spaced apart permitting tilting movement of said substrate, one of said hook means having its stop means spaced from the other a greater distance of the stop means of said other hook means.

3. The substrate holder as claimed in claim 2, wherein said substrate holding means further includes a plurality of diverging fingers, ring member connected to said diverging fingers and disposed normal to said rod like member with said hook means disposed on said ring member.

4. The substrate holder as claimed in claim 3, wherein one of the pairs of said stop means of each hook means is located near said ring member and the other spaced from the plane of said ring member to permit said substrate to move between said stop means.

5. A substrate holder as claimed in claim 4, wherein said hook means are arranged in planar groups to support a plurality of substrates.

6. The substrate holder as claimed in claim 5, further including extensions of said diverging fingers with said hook means connected to said extensions.

7. A substrate holder adapted for practicing liquid phase epitaxy, comprising:

a dipping rod, substrate holding means connected to one end of said rod and comprising a substrate engaging means in the form of pairs of stop means spaced apart permitting tilting movement of said substrate, one of said substrate engaging means having its stop means spaced from the other a greater distance of the stop means of said other substrate engaging means so that when said substrate is free of liquid epitaxy melt said substrate is tilted and when said substrate is within an epitaxy melt said substrate assumes a horizontal position while yet contained in and by said substrate holder.

* * * * *